United States Patent [19]

Marburger et al.

[11] 3,998,407

[45] Dec. 21, 1976

[54] FOLDING TAIL FINS

[75] Inventors: Ivan L. Marburger, Upland, Calif.; Donald E. Howlett, Reno, Nev.; Lawrence J. Nagel, La Verne, Calif.

[73] Assignee: The United States of America as represented by the Secretary of the Army, Washington, D.C.

[22] Filed: Dec. 4, 1975

[21] Appl. No.: 637,601

Related U.S. Application Data

[62] Division of Ser. No. 493,005, July 30, 1974, Pat. No. 3,946,969.

[52] U.S. Cl. ..... 244/3.28

[51] Int. Cl.[2] ..... F42B 13/32

[58] Field of Search ..... 244/3.27, 3.28, 3.29

[56] References Cited

UNITED STATES PATENTS

| | | | |
|---|---|---|---|
| 3,098,446 | 7/1963 | Jasse | 244/3.28 |
| 3,196,793 | 7/1965 | Milenkovic et al. | 244/3.28 |

FOREIGN PATENTS OR APPLICATIONS

| | | | |
|---|---|---|---|
| 232,850 | 11/1958 | Switzerland | 244/3.28 |
| 977,111 | 12/1964 | United Kingdom | 244/3.28 |

*Primary Examiner*—Verlin R. Pendegrass
*Attorney, Agent, or Firm*—Nathan Edelberg; Robert P. Gibson; Herbert H. Murray

[57] ABSTRACT

A rocket having flip out tail fins with cooperating surfaces on said fins and the rear of said rocket to maintain said fins in extended position. Spring means for urging said cooperating surfaces into engagement with each other.

1 Claim, 3 Drawing Figures

FOLDING TAIL FINS

This is a division of application Ser. No. 493,005, filed July 30, 1974, and now U.S. Pat. No. 3,946,969.

BACKGROUND OF THE INVENTION

In a tube launched rocket the tail fin structure must be capable of being folded or retracted to within the missile profile while the missile is within the launch tube. The fins must then be capable of extension into the air stream after launch. Means must be provided to firmly maintain said fins in their extended position.

In accordance with the need it is an object of this invention to provide a flip out fin structure which can be maintained in its extended position.

DETAILED DESCRIPTION OF THE INVENTION

Figure 1:
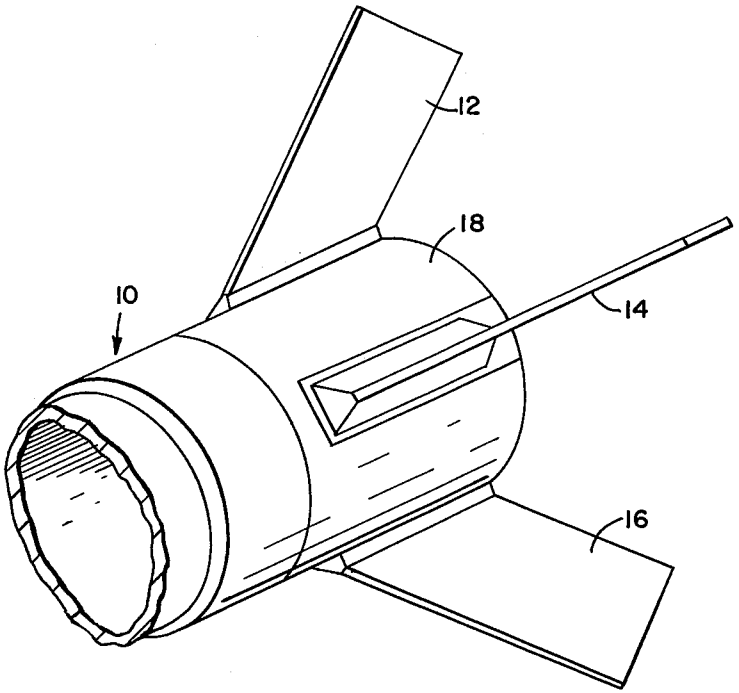
FIG. 1 is a perspective of the rear portion of a missile illustrating the fins of the present invention.

Referring now to the drawings and particularly to FIG. 1, 10 generally indicates the rear portion of a missile. Four fins, only three of which are shown at 12, 14, and 16, are attached to the rear end of the missile 10. Each of the fins is attached to the missile 10 in the same manner. A shroud 18 is attached to the missile 10 and the fins are adapted to project through slots in the shroud.

Figure 2:
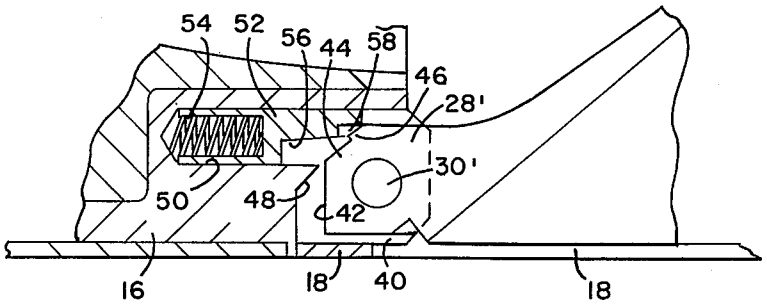
FIG. 2 shows the fin mounting structure of FIG. 1 with the fin in retracted position.
Figure 3:
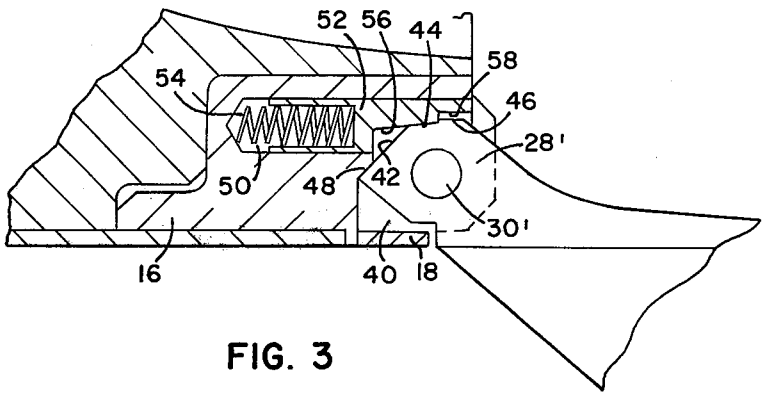
FIG. 3 is similar to FIG. 2 but shows the fin in extended position.

Referring now to FIGS. 2 and 3 two spaced lugs or bosses 40 are formed at four points around the periphery of the rear of the missile 10 and project rearwardly therefrom. The fin 12 is provided with a hub 28' pivotally mounted on a hinge pin 30' which extends between the lugs 40.

The hub 28' is provided with a flat surface 42. Another flat surface 44 is adjacent to flat surface 42 and at an angle with respect thereto. A lug 46 projects outwardly from the flat surface 46.

The rear of the missile 10 is provided adjacent the fin hub 28' with a diagonal flat surface 48. Adjacent each hub 28', the rear of the missile 10 is provided with a recess 50. A plunger 52 is slidably received in each recess 50 and is spring pressed rearwardly by a spring 54. The plunger 52 is provided with an outwardly facing flat surface 56. The rearmost end of the surface 56 is cut out as recessed as indicated at 58.

As the fin 12 moves from its retracted position illustrated in FIG. 2 to its extended position illustrated in FIG. 3 the flat surface 42 on the hub 28' abuts the flat surface 48 on the rear of missile 10 to limit the outward movement of the fin 12. The plunger 52 moves rearwardly under the influence of the spring 54 until the flat surface 56 thereon abuts the flat surface 44 on the hub 28' thus wedging the fin 12 in its extended position. The lug 46 is received within the recess 58 on the plunger 52 to further lock the fin 12 in its extended position.

I claim:

1. A flip out tail assembly for a missile comprising:

pairs of lugs extending rearwardly from said missile, said missile having a diagonal flat surface at the rear thereof;

four fins each having a hinged hub portion pivotally secured between said pair of lugs, each said hinged hub portion having a first flat surface and a second flat surface inclined at an angle thereto, a lug disposed on said second flat surface and projecting upwardly therefrom;

a plunger slidably mounted in the rear of said missile adjacent each said pair of lugs; each said plunger having an outwardly facing flat surface having a recess at the rearmost end thereof;

spring means for biasing said plunger against said hinged hub portion whereby said fin is pivoted outwardly so that said lug on said hinged hub portion enters said recess on said plunger and said first flat surface of said hub portion engages said diagonal surface of the rearend of said missile for retention of said fin in the extended position; and a shroud assembly fixed to said missile and having four longitudinal slots formed therein through which the fins are adapted to project.

* * * * *